US012667760B1

(12) United States Patent
Xue et al.

(10) Patent No.: US 12,667,760 B1
(45) Date of Patent: Jun. 30, 2026

(54) AUTOMATIC WATER OUTLET BRUSH FOR GOLF CLUB

(71) Applicant: Shenzhen Huahanxing Technology Co., Ltd., Shenzhen (CN)

(72) Inventors: Wenfeng Xue, Shangrao (CN); Zaofa Xue, Shangrao (CN)

(73) Assignee: Shenzhen Huahanxing Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/325,608

(22) Filed: Sep. 11, 2025

(51) Int. Cl.

| | |
|---|---|
| ***A63B 57/60*** | (2015.01) |
| ***A46B 11/00*** | (2006.01) |
| *A63B 47/04* | (2006.01) |
| *A63B 60/00* | (2015.01) |

(52) U.S. Cl.
CPC ..... *A63B 57/60* (2015.10); *A46B 11/001* (2013.01); *A63B 47/04* (2013.01); *A63B 60/00* (2015.10)

(58) Field of Classification Search
CPC ..... A63B 57/60; A63B 47/04; A63B 60/36
See application file for complete search history.

(56) References Cited

U.S. PATENT DOCUMENTS

| | | | | |
|---|---|---|---|---|
| 6,021,537 | A * | 2/2000 | Smith | A46B 13/04 15/21.2 |
| 10,245,472 | B1 * | 4/2019 | Worsham | A63B 47/025 |
| 10,631,696 | B1 * | 4/2020 | Williamson | A47L 9/0693 |
| 2019/0308078 | A1 * | 10/2019 | Smith | A63B 55/408 |
| 2023/0061481 | A1 * | 3/2023 | Menn | A63B 47/04 |

FOREIGN PATENT DOCUMENTS

| | | |
|---|---|---|
| CN | 214340751 U | 10/2021 |
| CN | 221618519 U | 8/2024 |

* cited by examiner

*Primary Examiner* — Michael D Jennings

(57) ABSTRACT

An automatic water outlet brush for a golf club comprises a shell, a water spraying component, a brush head component and a water storage bottle; wherein the brush head component is arranged at an upper end of the shell, the water storage bottle is arranged at a lower end of the shell; the water spraying component comprises a water pump, an upper end of the water pump is connected with a water outlet pipe, a lower end of the water pump is connected with a water inlet pipe, the water inlet pipe extends into the water storage bottle, the water outlet pipe is communicated with the brush head component; a switch key is arranged on the shell, and the switch key is electrically connected with the water pump, so that automatic water spraying is realized during brushing by the water pump, and the cleaning efficiency is improved.

9 Claims, 9 Drawing Sheets

AUTOMATIC WATER OUTLET BRUSH FOR GOLF CLUB

TECHNICAL FIELD

The present invention relates to the technical field of cleaning devices, in particular to an automatic water outlet brush for a golf club.

BACKGROUND OF THE PRESENT INVENTION

A golf club is basic equipment of golf, which consists of three parts: a ball head, a club shaft and a grip. According to different hitting purposes, the club has significant differences in a club head shape and a club shaft length, and is mainly divided into a wood, an iron, a wedge and a putter. After long-term use, a surface of the club is easy to attach dirt and other stains, which need to be cleaned in time to extend a service life thereof.

However, most of present golf club cleaning brushes have two shortcomings: firstly, they lack a function of automatic water spraying and rely on external water source equipment, which significantly reduces the cleaning efficiency; secondly, a seal design is not good, which makes the nozzle and water storage bottle easy to leak.

In view of the shortcomings of the prior art, the present invention aims to provide a water outlet brush with an automatic water spraying function and a good sealing performance.

SUMMARY OF THE PRESENT INVENTION

The present invention provides an automatic water outlet brush for a golf club, which solves a problem that a golf club cleaning brush may not automatically spray water and has poor sealing performance in the prior art.

In order to achieve the above purpose, the main technical solution adopted in the present invention is as follows: an automatic water outlet brush for a golf club comprises a shell, a water spraying component, a brush head component and a water storage bottle; wherein the brush head component is arranged at an upper end of the shell, the water storage bottle is arranged at a lower end of the shell; the water spraying component is arranged in the shell and comprises a water pump, a water inlet pipe and a water outlet pipe; the water inlet pipe extends into the water storage bottle, the water outlet pipe is communicated with the brush head component; a switch key is arranged on the shell, and the switch key is electrically connected with the water pump.

Preferably, a lower end of the shell is provided with a lower connecting base, an upper end of the shell is provided with an upper connecting base, the brush head component is hermetically connected with the upper connecting base, and the water storage bottle is hermetically connected with the lower connecting base.

Preferably, the brush head component comprises a brush holder and a waterproof plug; wherein, the brush holder is in threaded connection with the upper connecting base, the waterproof plug is arranged between the brush holder and the upper connecting base; the brush holder is provided with a positioning bump, the upper connecting base is provided with a projection, when the brush holder is tightened, the projection contacts with the positioning bump to fix an orientation of the brush holder.

Preferably, the brush holder is provided with a plurality of bristles and water nozzles, the upper connecting base is provided with a spray pipe inlet and a spray pipe outlet; wherein, the spray pipe inlet is butted with the water outlet pipe; and the spray pipe outlet is communicated with the water nozzle.

Preferably, the waterproof plug is sleeved on an outer periphery of the spray pipe outlet, and an inner ring surface of the waterproof plug is provided with an anti-dropping thread, which contacts with the outer periphery of the spray pipe outlet.

Preferably, the plurality of water nozzles are provided.

Preferably, the shell comprises a lower shell and an upper shell.

Preferably, a bottom part of the water inlet pipe is provided with a gravity ball for keeping the water inlet pipe always immersed below a liquid level.

Preferably, a battery compartment is arranged on the lower shell, a battery is installed in the battery compartment, a cover plate is detachably connected to the battery compartment, and a waterproof pad is arranged between the cover plate and the battery compartment.

Preferably, the lower connecting base is in threaded connection with the water storage bottle, a washer is arranged between the water storage bottle and the lower connecting base; and the lower connecting base and the upper connecting base are both fixedly connected with the shell through a bolt.

The automatic water outlet brush provided by the present invention has the following advantages:

1. By arranging the water spraying component, the upper end of the water pump is connected with the water outlet pipe, the lower end of the water pump is connected with the water inlet pipe, which extends into the water storage bottle, and the water outlet pipe is communicated with the brush head component. When the switch key is turned on, the water pump starts to work, and the water in the water storage bottle is sucked out through the water inlet pipe and discharged from the water outlet pipe and the brush head component, thus realizing automatic water spraying during brushing.

2. The brush holder is in threaded connected with the upper connecting base, and the waterproof plug is arranged between the brush holder and the upper connecting base; the inner ring surface of the waterproof plug is provided with the anti-dropping thread, the waterproof plug is sleeved on the outer periphery of the spray pipe outlet, and the anti-dropping thread contacts with the outer periphery of the spray pipe outlet; when the brush holder needs to be disassembled, the waterproof plug will be firmly fixed on the spray pipe outlet and will not fall off.

3. The upper end of the upper connecting base is provided with the projection, the brush holder is provided with the positioning bump; when the brush holder is installed on the upper connecting base, the brush holder is tightened counterclockwise until the protrusion contacts with the positioning bump, and at this time, the brush holder is tightened and just in a vertical position; through the arrangement of the protrusion and the positioning bump, the brush holder is ensured to be in the same orientation every time, so that an operator may conveniently use the automatic water outlet brush of the present invention for brushing operation.

The above description is only an overview of the technical solution of the present invention. In order to clearly understand the technical means of the present invention and implement it according to the contents of the specification, the following is a detailed description of the preferred embodiment of the present invention with the accompanying drawings. Specific embodiments of the present invention are given in detail by the following examples and drawings thereof.

DESCRIPTION OF THE DRAWINGS

The accompanying drawings described herein are provided for a further understanding of the present invention and constitute a part of the present invention. The illustrative embodiments of the present invention and descriptions thereof are used for explaining the present invention and do not constitute undue limitations on the present invention. In the accompanying drawings.

Figure 1:
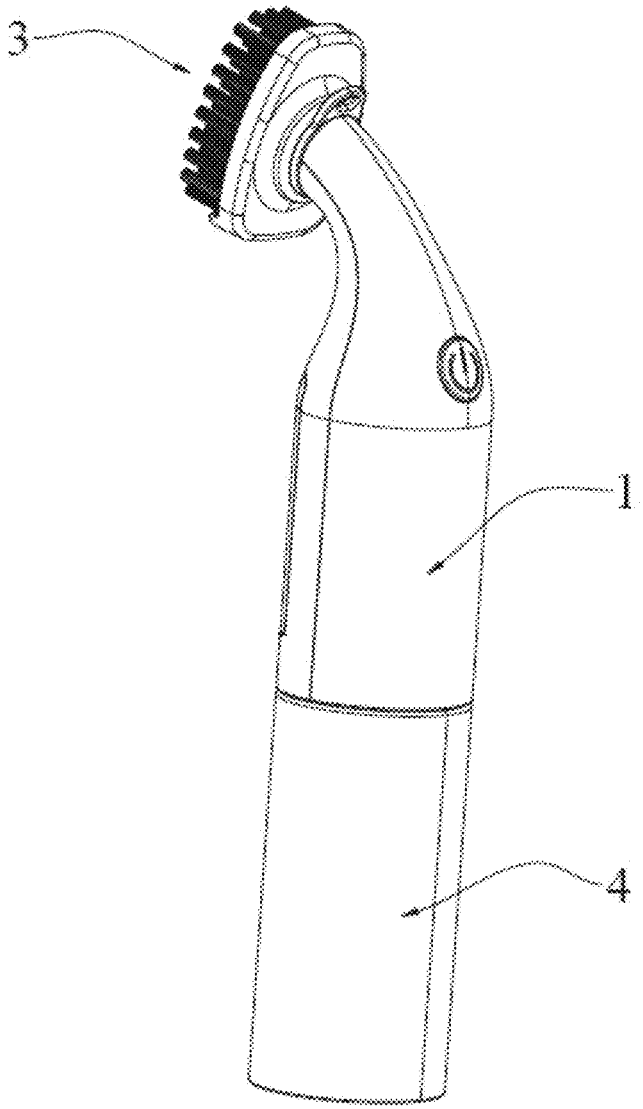
FIG. 1 is a schematic structural diagram of an automatic water outlet brush provided by the present invention.

In the drawings, a component list represented by each symbol is as follows:

1—shell; 11—lower shell; 12—upper shell; 13—lower connecting base; 14—washer; 15—upper connecting base; 151—spray pipe inlet; 152—projection; 153—spray pipe outlet; 16—cover plate; and 17—switch key;

2—water spraying components; 21—water pump; 22—water inlet pipe; 23—gravity ball; 24—water outlet pipe; and 25—battery;

3—brush head component; 31—brush holder; 311—bristle; 312—water nozzle; 313—positioning bump; 32—waterproof plug; and 321—anti-dropping thread; and

4—water storage bottle.

DETAILED DESCRIPTION OF PREFERRED EMBODIMENTS

The principles and features of the present invention are described hereinafter with reference to FIG. 1 to FIG. 9, and the examples given are only for explaining the present invention, not for limiting its scope. In the following paragraphs, the present invention will be described in more detail by way of example with reference to the accompanying drawings. Advantage and features of the present invention will become more apparent from the follow description and claims. It should be noted that all the drawings are in a very simplified form and use inaccurate proportions, which are only used for facilitating and clearly illustrating the purpose of the embodiment of the present invention.

It should be noted that when a component is said to be "fixed" to another component, it can be directly on another component or there can be a component in the middle. When a component is considered to be "connected" to another component, it can be directly connected to another component or there may be a component in the middle at the same time. When a component is considered to be "arranged on" another component, it can be directly arranged on another component or there may be a component in the middle at the same time. The terms "vertical", "horizontal", "left" and "right" and similar expressions used in the specification are for illustration purposes only.

Unless otherwise defined, all technical and scientific terms used herein have the same meaning as commonly understood by those skilled in the art of the present invention. The terms used in the specification of the present invention herein is only for the purpose of describing specific embodiments, and is not intended to limit the present invention. The term "and/or" as used herein includes any and all combinations of one or more related listed items.

Embodiment

Figure 2:
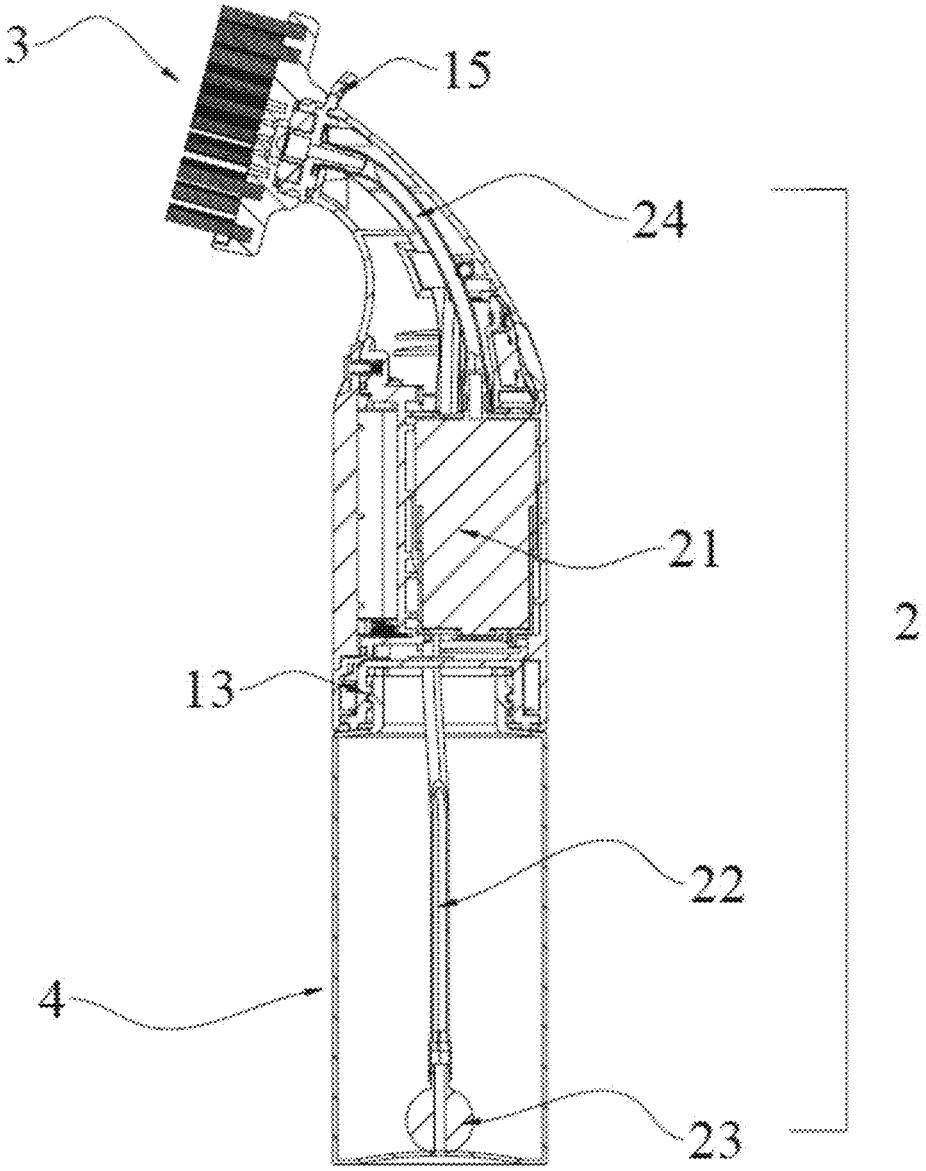
FIG. 2 is a sectional view of the automatic water outlet brush provided by the present invention.

As shown in FIG. 1 to FIG. 2 provided by the embodiment of the present invention, an automatic water outlet brush for a golf club provided by the present invention comprises a shell 1, a water spraying component 2, a brush head component 3 and a water storage bottle 4; the brush head component 3 is arranged at an upper end of the shell 1; the water storage bottle 4 is arranged at a lower end of the shell 1; the water spraying component 2 is arranged in the shell 1, and comprises a water pump 21, a water inlet pipe 22 and a water outlet pipe 24, an upper end of the water pump 21 is connected with the water outlet pipe 24, a lower end of the water pump 21 is connected with the water inlet pipe 22, which extends into the water storage bottle 4, a bottom part of the water inlet pipe 22 is provided with a gravity ball 23, and the water outlet pipe 24 is communicated with the brush head component 3. Because the water inlet pipe 22 is a hose, when the automatic water outlet brush is used for brushing, directions of the brush head component 3 and the water storage bottle 4 will change at any time (such as up, down, left or right) with hand movements, and the gravity ball 23 may always be submerged under a liquid surface of the water storage bottle 4, so that the water inlet pipe 22 may always suck the liquid in the water storage bottle 4.

The shell 1 is provided with a switch key 17, which is electrically connected with the water pump 21. When the switch key 17 is turned on, the water pump 21 starts to work, and the water in the water storage bottle 4 is sucked out through the water inlet pipe 22 and discharged from the water outlet pipe 24 and the brush head component 3.

Figure 3:
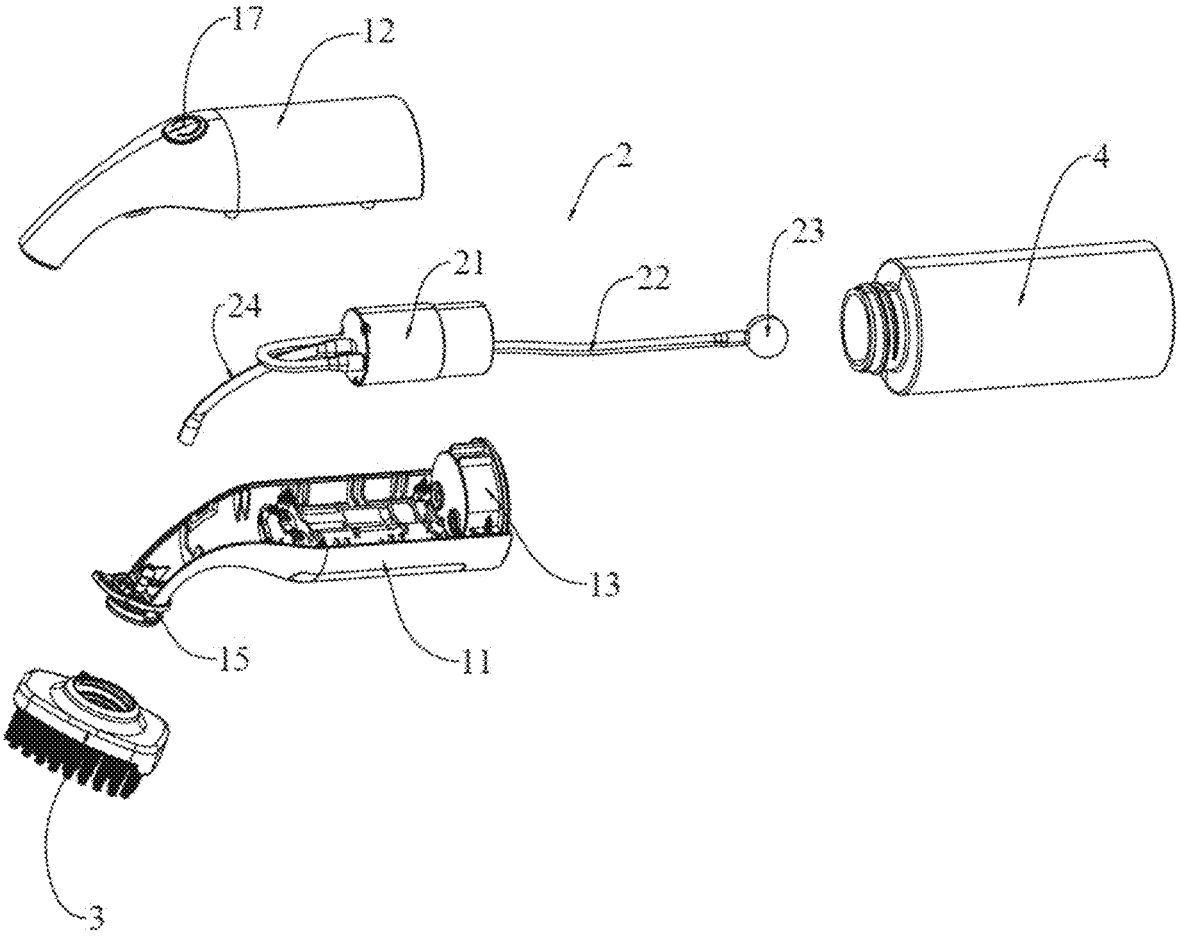
FIG. 3 is an explosion schematic diagram of the automatic water outlet brush provided by the present invention.

As shown in FIG. 3, the shell 1 comprises a lower shell 11 and an upper shell 12. The lower end of the shell 1 is provided with a lower connecting base 13, and the upper end of the shell 1 is provided with an upper connecting base 15. Both the lower connecting base 13 and the upper connecting base 15 are fixedly connected with the shell 1, and a fixed connection mode can be bolt connection, glue bonding or integral molding.

Figure 4:
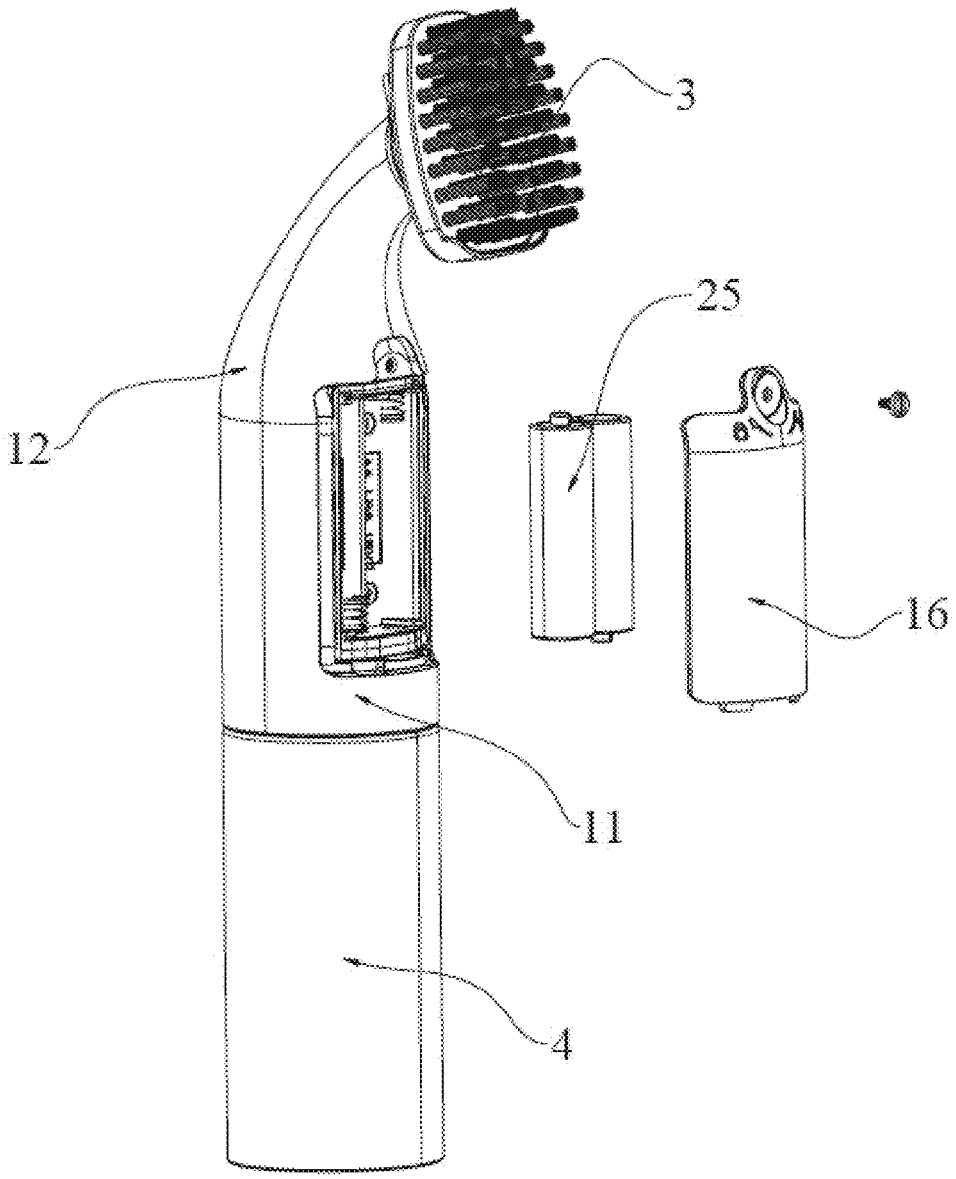
FIG. 4 is another explosion schematic diagram of the automatic water outlet brush provided by the present invention.
Figure 5:
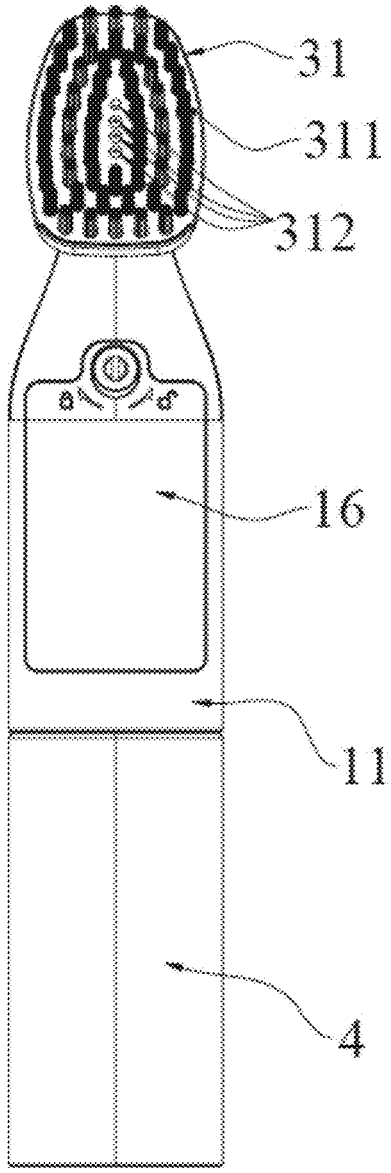
FIG. 5 is another schematic structural diagram of the automatic water outlet brush provided by the present invention.

As shown in FIG. 4 to FIG. 5, a battery compartment is arranged on the lower shell 11, and a battery 25 is installed in the battery compartment. A cover plate 16 is detachably connected to the battery compartment, and a waterproof pad is arranged between the cover plate 16 and the battery compartment, and is used for preventing the cleaning liquid from infiltrating into the battery compartment.

In order to prevent water leakage, the brush head component 3 is hermetically connected with the upper connecting base 15, and the water storage bottle 4 is hermetically connected with the lower connecting base 13. The lower connecting base 13 and the water storage bottle 4 may be in threaded connection (as shown in FIG. 3) or in a clamping manner (not shown), and a washer 14 (as shown in FIG. 6) is arranged between the water storage bottle 4 and the lower connecting base 13.

As shown in FIG. 6 to FIG. 9, the brush head component 3 comprises a brush holder 31 and a waterproof plug 32; the brush holder 31 is provided with a plurality of bristles 311, water nozzles 312 and a positioning bump 313, and an array of the plurality of bristles 311 is arranged on a surface of the brush holder 31; in addition, in order to make the brush head component 3 spray the cleaning liquid uniformly, the plurality of water nozzles 312 are provided (as shown in FIG. 5), and the plurality of water nozzles 312 are uniformly arranged in a middle part of the brush holder 31 in a straight line, or the plurality of water nozzles 312 are arranged on a surface of the brush holder 31 in a circumferential array.

The brush base 31 is in threaded connection with the upper connecting base 15, and the waterproof plug 32 is arranged between the brush holder 31 and the upper connecting base 15. The upper connecting base 15 is provided with a spray pipe inlet 151, a protrusion 152 and a spray pipe outlet 153, wherein the spray pipe inlet 151 and the spray pipe outlet 153 are respectively arranged at a rear side and a front side of the upper connecting base 15, the spray pipe inlet 151 is communicated with the spray pipe outlet 153, and is butted with the water outlet pipe 24, and the spray pipe outlet 153 is communicated with the water nozzle 312. When the water pump 21 starts to work, the water in the water storage bottle 4 is suck out through the water inlet pipe 22, and discharged from the spray pipe inlet 151, the spray pipe outlet 153 and the water nozzle 312 in sequence through the water outlet pipe 24.

Figure 6:
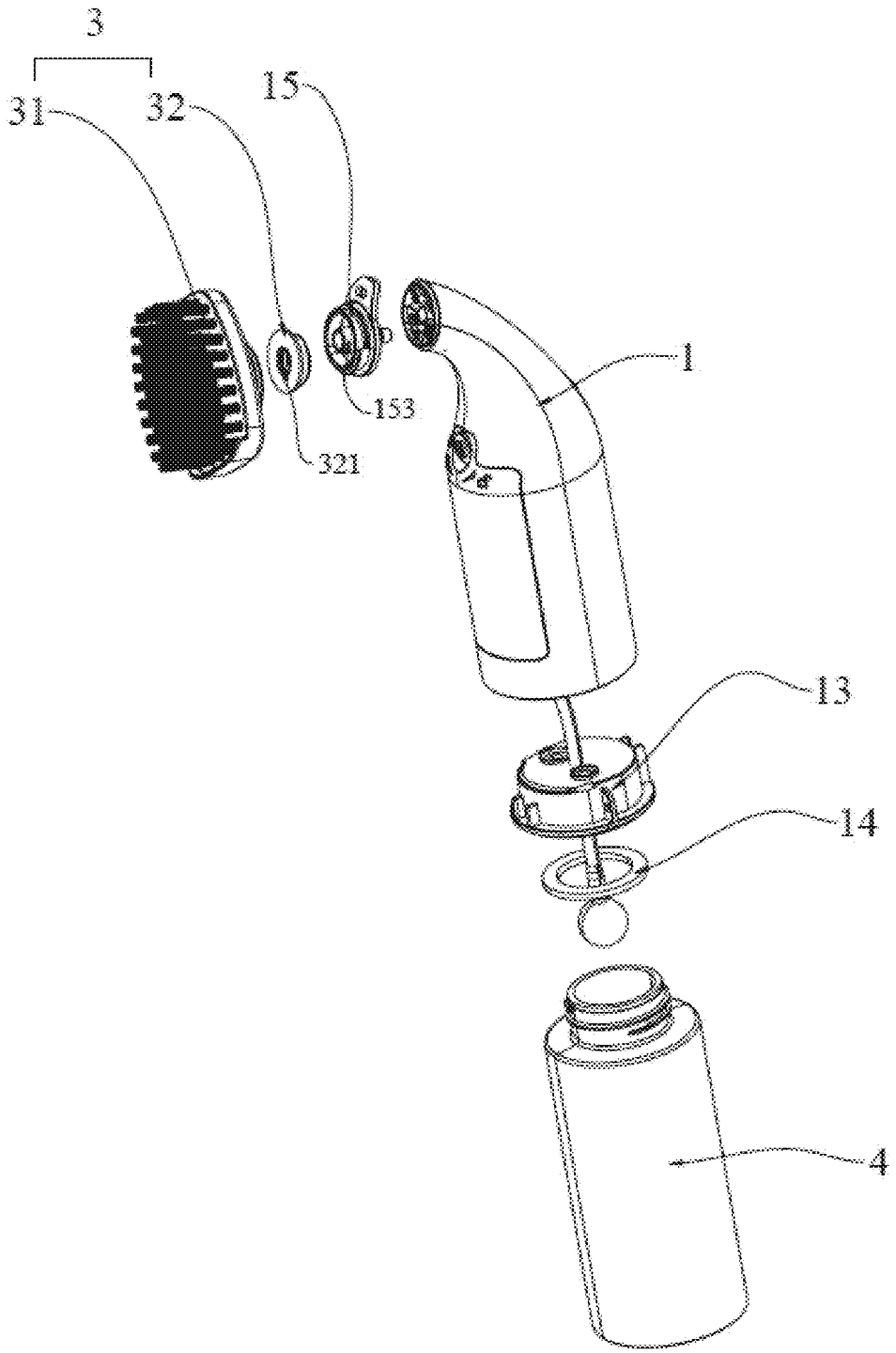
FIG. 6 is another explosion schematic diagram of the automatic water outlet brush provided by the present invention.
Figure 7:
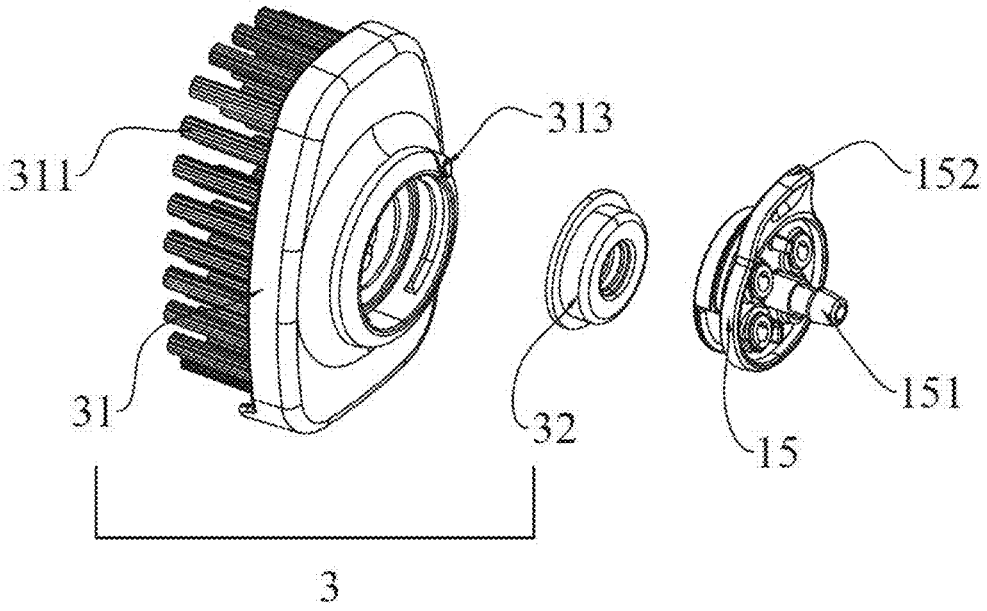
FIG. 7 is an explosion schematic diagram of a brush head component provided by the present invention.

As shown in FIG. 6 to FIG. 7, in order to prevent the waterproof plug 32 from falling off when the brush holder 31 is assembled and disassembled, the waterproof plug 32 is sleeved on the outer periphery of the spray pipe outlet 153, and the inner ring surface of the waterproof plug 32 is provided with an anti-dropping thread 321, which contacts with the outer periphery of the spray pipe outlet 153. When the brush holder 31 needs to be disassembled, the waterproof plug 32 will be firmly fixed on the spray pipe outlet 153 and will not fall off.

Figure 8:
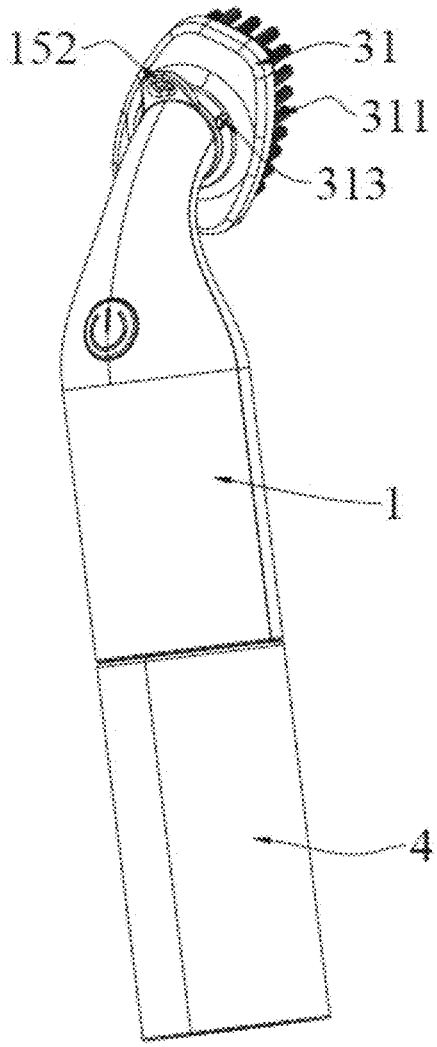
FIG. 8 is a schematic diagram of a process of tightening the brush head component provided by the present invention.
Figure 9:
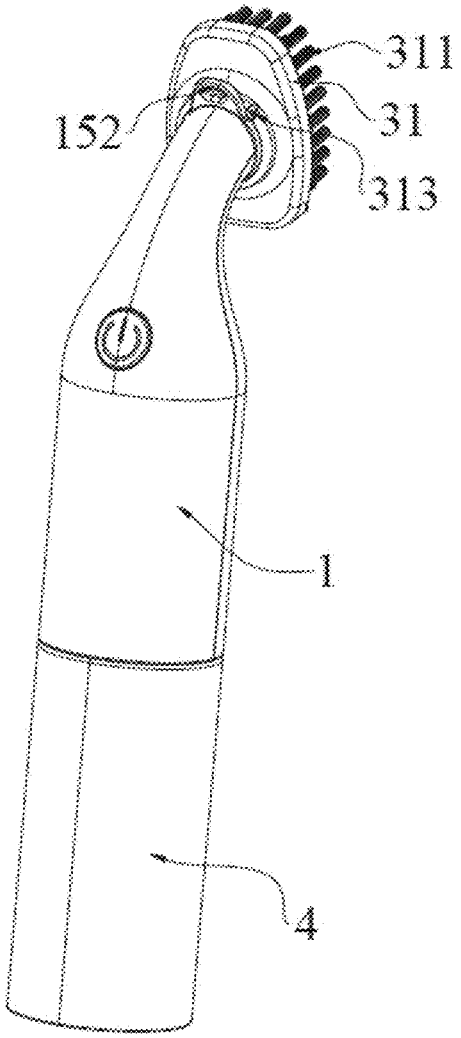
FIG. 9 is a schematic diagram after finishing tightening the brush head component provided by the present invention.

Further, in order to ensure that the brush holder 31 is in a correct orientation after installation, that is, always in a vertical direction (as shown in FIG. 5 and FIG. 9), the protrusion 152 is arranged at the upper end of the upper connecting base 15. During the tightening of the brush holder 31, the brush holder 31 rotates counterclockwise (as shown in FIG. 8) until the protrusion 152 contacts with the positioning bump 313. At this time, the brush holder 31 is completely tightened and is just in the vertical position (as shown in FIG. 9). Through the arrangement of the protrusion 152 and the positioning bump 313, the orientation of the brush holder 31 is fixed, so as to ensure that the brush holder 31 is in the same orientation every time, so as to facilitate the operator to use the automatic water outlet brush of the present invention for brushing operation.

The automatic water outlet brush for the golf club provided by the present invention may be used not only for cleaning golf balls and clubs, but also for cleaning shoes, washstands, kitchens and other daily scenes.

It should be noted that in the specification, relational terms such as first and second are only used for distinguishing one entity or operation from another entity or operation, and do not necessarily require or imply that there is any such actual relationship or order between these entities or operations. What is not described in detail in the specification belongs to the prior art known to those skilled in the art.

The above is only the preferred embodiment of the present invention, and does not limit the present invention in any form; all ordinary technicians in the industry may smoothly implement the present invention as shown in the attached drawings and described above. However, any equivalent changes made by those skilled familiar in the art by using the technical contents disclosed above without departing from the scope of the technical scheme of the present invention are equivalent embodiments of the present invention. Meanwhile, any equivalent changes, modifications and evolutions made to the above embodiments according to the essential technology of the present invention still fall within the protection scope of the technical solution of the present invention.

We claim:

1. An automatic water outlet brush for a golf club, comprising a shell (1), a water spraying component (2), a brush head component (3) and a water storage bottle (4), wherein, the brush head component (3) is arranged at an upper end of the shell (1), the water storage bottle (4) is arranged at a lower end of the shell (1);

the water spraying component (2) is arranged in the shell (1) and comprises a water pump (21), a water inlet pipe (22) and a water outlet pipe (24); the water inlet pipe (22) extends into the water storage bottle (4), and the water outlet pipe (24) is communicated with the brush head component (3); and a switch key (17) is arranged on the shell (1), and the switch key (17) is electrically connected with the water pump (21);

wherein a lower end of the shell (1) is provided with a lower connecting base (13), an upper end of the shell (1) is provided with an upper connecting base (15), the brush head component (3) is hermetically connected with the upper connecting base (15), and the water storage bottle (4) is hermetically connected with the lower connecting base (13).

2. The automatic water outlet brush for the golf club according to claim 1, wherein the brush head component (3) comprises a brush holder (31) and a waterproof plug (32); wherein, the brush holder (31) is in threaded connection with the upper connecting base (15), and the waterproof plug (32) is arranged between the brush holder (31) and the upper connecting base (15); and the brush holder (31) is provided with a positioning bump (313), the upper connecting base (15) is provided with a projection (152), when the brush holder (31) is tightened, the projection (152) contacts with the positioning bump (313) to fix an orientation of the brush holder (31).

3. The automatic water outlet brush for the golf club according to claim 2, wherein, the brush holder (31) is provided with a plurality of bristles (311) and water nozzles (312), and the upper connecting base (15) is provided with a spray pipe inlet (151) and a spray pipe outlet (153); wherein, the spray pipe inlet (151) is butted with the water outlet pipe (24); and the spray pipe outlet (153) is communicated with the water nozzle (312).

4. The automatic water outlet brush for the golf club according to claim 3, wherein, the waterproof plug (32) is sleeved on an outer periphery of the spray pipe outlet (153), and an inner ring surface of the waterproof plug (32) is provided with an anti-dropping thread (321), which contacts with the outer periphery of the spray pipe outlet (153).

5. The automatic water outlet brush for the golf club according to claim 3, wherein, the plurality of water nozzles (312) are provided.

6. The automatic water outlet brush for the golf club according to claim 1, wherein the shell (1) comprises a lower shell (11) and an upper shell (12).

7. The automatic water outlet brush for the golf club according to claim 6, wherein a battery compartment is arranged on the lower shell (11), a battery (25) is installed in the battery compartment, a cover plate (16) is detachably connected to the battery compartment, and a waterproof pad is arranged between the cover plate (16) and the battery compartment.

8. The automatic water outlet brush for the golf club according to claim 1, wherein a bottom part of the water inlet pipe (22) is provided with a gravity ball (23) for keeping the water inlet pipe (22) always immersed below a liquid level.

9. The automatic water outlet brush for the golf club according to claim 1, wherein the lower connecting base (13) is in threaded connection with the water storage bottle (4), a washer (14) is arranged between the water storage bottle (4) and the lower connecting base (13); and the lower connecting base (13) and the upper connecting base (15) are both fixedly connected with the shell (1) through a bolt.

* * * * *